US007735407B2

(12) United States Patent
Keener et al.

(10) Patent No.: US 7,735,407 B2
(45) Date of Patent: Jun. 15, 2010

(54) PROJECTILE RESISTANT MATERIAL

(76) Inventors: James H. Keener, 1233 La Madronna, Santa Cruz, CA (US) 95060; Matt Jacobs, 3497 Maple Thorpe La., Soquel, CA (US) 95073

( * ) Notice: Subject to any disclaimer, the term of this patent is extended or adjusted under 35 U.S.C. 154(b) by 430 days.

(21) Appl. No.: 11/486,242

(22) Filed: Jul. 12, 2006

(65) Prior Publication Data

US 2009/0320674 A1 Dec. 31, 2009

(51) Int. Cl.

| | |
|---|---|
| ***F41H 5/02*** | (2006.01) |
| ***F41H 5/06*** | (2006.01) |
| ***B05D 5/02*** | (2006.01) |
| ***B05D 1/02*** | (2006.01) |
| ***B28B 19/00*** | (2006.01) |

(52) U.S. Cl. ..... 89/36.02; 89/903; 89/918; 427/386; 427/427.4

(58) Field of Classification Search ..... 89/36.02; 442/135; 427/386, 427.4

See application file for complete search history.

(56) References Cited

U.S. PATENT DOCUMENTS

| | | | | |
|---|---|---|---|---|
| 3,573,150 | A * | 3/1971 | Broutman et al. | 428/105 |
| 3,916,060 | A * | 10/1975 | Fish et al. | 428/299.4 |
| 4,048,365 | A * | 9/1977 | Hoover | 428/215 |
| 4,911,062 | A * | 3/1990 | Heyman | 89/36.02 |
| 5,343,796 | A * | 9/1994 | Cordova et al. | 89/36.02 |
| 5,440,965 | A * | 8/1995 | Cordova et al. | 89/36.02 |
| 6,003,424 | A * | 12/1999 | Cordova et al. | 89/36.02 |
| 6,276,254 | B1 * | 8/2001 | Cordova et al. | 89/36.02 |
| 6,945,155 | B2 * | 9/2005 | Cordova et al. | 89/36.02 |
| 2003/0200861 | A1 * | 10/2003 | Cordova et al. | 89/36.02 |
| 2004/0094863 | A1 | 5/2004 | Bürge et al. | 264/219 |
| 2005/0053787 | A1 | 3/2005 | Yamasaki et al. | 428/411.1 |
| 2006/0027089 | A1 * | 2/2006 | Cordova et al. | 89/36.02 |
| 2007/0117483 | A1 | 5/2007 | Bhatnagar et al. | 442/123 |
| 2007/0238379 | A1 | 10/2007 | Bhatnagar et al. | 442/135 |
| 2008/0176051 | A1 | 7/2008 | Nguyen et al. | 428/219 |

FOREIGN PATENT DOCUMENTS

| | | |
|---|---|---|
| EP | 84200106.7 | 11/1984 |

OTHER PUBLICATIONS

Sonocrete Epogel, Datasheet [online], Sonnenborn, Jan. 2002 . Retrieved from the Inernet: <URL: http://www.cadeco.com/productfiles/Sonneborn-Epogel.pdf>.

* cited by examiner

*Primary Examiner*—Bret Hayes
(74) *Attorney, Agent, or Firm*—Haverstock & Owens LLP

(57) ABSTRACT

A method of applying, through spray on, extruded or flow-on application, a projectile resistant material. The method includes selecting an epoxy, selecting a fiber, selecting a ratio for combining the epoxy and the fiber, based on the ratio, combining the epoxy and the fiber to form a malleable projectile resistant type material, and applying the material. The projectile resistant material includes an epoxy and several fibers. The fibers are mixed within the epoxy based on a predetermined ratio. The predetermined ratio is for determining the projectile resistance of the material. The fibers are randomly disposed within the epoxy.

39 Claims, 3 Drawing Sheets

PROJECTILE RESISTANT MATERIAL

FIELD OF THE INVENTION

The present invention is related to the field of protective armor and/or shielding. More specifically the present invention is directed to projectile resistant material of short length high tensile strength fibers in resin or epoxy.

BACKGROUND

Historically, in the field of bullet proofing, armored vehicles used heavy metal plates as protective armor. More recently, wearable bullet resistant materials have been fabricated by long strand fibers, such as weaving Kevlar® or a similar aromatic polyamide (or "Aramid") fiber into cloth. The cloth is then cut and stitched to construct wearable personal body armor. The cloth is also incorporated into bullet proofing vehicles including military vehicles. The length of the fibers associated with the friction along the length provide the strength.

However, the approaches known in the art suffer a number of drawbacks. For instance, heavy metal plating for armored vehicles undesirably adds to the weight of the vehicle, which reduces the speed of the vehicle, reduces load bearing capability of the vehicle, and increases the maintenance and costs of operating the vehicle. Hence, the conventional methods of armoring a vehicle negatively impact the vehicle's effectiveness in the field, and reduces the useful life of the chassis and drive train components of the vehicle.

Both metal plates and fiber woven cloths are expensive. A typical steel armor plate for Level III threat protection costs about $5000. A 52" by 63" Spectra panel costs about $6000. These are only the material costs, and do not include installation costs.

Moreover, the manufacturing processes for forming metal plating and also weaving fibers are complex, costly and time consuming. Further, deploying these conventional materials is non trivial. The conventional materials are difficult to work with, rigid, or unmalleable, and hence, are difficult to implement in tight areas such as the pillars, frame, and doors of a vehicle for example. Accordingly, specific implementations of the conventional armoring techniques often require extensive modifications. For instance, armor for a vehicle door often requires accommodation for the functional latch components of the door.

Further, the conventional methods are severely limited for implementation in potentially high value and/or critical situations, such as for example, during combat and/or at a forward field position. Meanwhile, the need for broader ranging, more cost effective applications of projectile protection grows, for example, with the proliferation of guerilla style and urban attacks. These attacks not only comprise bullets, but also mines, grenades, other explosives, and the like.

SUMMARY

A method of applying a projectile resistant material includes selecting an epoxy, selecting a fiber, and selecting a ratio for combining the epoxy and the fiber. The epoxy and the fiber are combined to the ratio to form a malleable projectile resistant type material. The combined material is then applied. The projectile resistant material includes an epoxy and several fibers. Preferably, the fibers include high molecular weight polyethylene type fibers. The fibers are mixed within the epoxy based on a predetermined ratio. The predetermined ratio is for determining the projectile resistance of the material. The fibers are randomly disposed within the epoxy. Applying the material in some embodiments includes spraying, while applying the material in some embodiments includes flowing or extruding the material. An automated mixing and dispensing machine is optionally used in some embodiments for applying the material. In some embodiments, the epoxy is a one, two or three part epoxy having the trade name Epogel. After a core period the epoxy hardens.

Typically, the fibers are cut fibers having varying lengths such as lengths in the range of about 15 millimeters to 100 millimeters, for example. Some fibers are coated and/or twisted. Preferably, the fibers include one or more from the set of trade names comprising Dyneema®, Kevlar®, Spectra®, and Zylon®. Other similar fibers are contemplated and suitable for use in the invention. When the selected fiber includes Dyneema® and/or Zylon®, the fiber has approximately 15 times the strength of steel by weight. In some embodiments, the fiber selected to form the material includes a combination of fibers.

Preferably, the fibers are mixed with the epoxy to form a random spatial arrangement of the fibers within the epoxy. In some of these embodiments, the epoxy comprises about 50% to 90% of the finished material. Varying the amount of fibers varies the ballistic resistance of the combined material in relationship to the choice of fiber material and the epoxy.

The ratio is selected based on a set of desired properties for the combined material. These properties include impact energy absorption (or "hardness"), drying time, strength, viscosity, ease of application, adhesion strength, sagging, weight, fire resistance, and color. The property of hardness is related to a projectile stopping power. The property of hardness is also related to the ability to distribute the force of a projectile impact. Distributing the force of the projectile impact generally spreads the projectile over a larger surface area.

The method of some embodiments further includes the additional steps of drying and curing the applied material. The material generally dries quickly, within the range of about 15 minutes to 120 minutes, and curing typically requires approximately 24 hours. In some instances, the material is useable within 24 hours, and further achieves maximum projectile resistance in about 72 hours.

As mentioned above, after combination and mixing, the material of some embodiments is sprayable. The material of other embodiments is extruded or flow applied. Regardless of its application, the material of the embodiments is often configured for quick application in a field situation. Further, the material of some embodiments, is configured for injection or extrusion into a hard to reach area. The hard to reach area includes a pillar, a roof, a frame rail, a body panel, and a floor board, such as on a vehicle, for example.

BRIEF DESCRIPTION OF THE DRAWINGS

The novel features of the invention are set forth in the appended claims. However, for purpose of explanation, several embodiments of the invention are set forth in the following figures.

DETAILED DESCRIPTION

In the following description, numerous details and alternatives are set forth for purpose of explanation. However, one of ordinary skill in the art will realize that the invention can be practiced without the use of these specific details. In other instances, well-known structures and devices are shown in block diagram form in order to not obscure the description of the invention with unnecessary detail.

I. Method of Manufacturing and Applying

Figure 1:
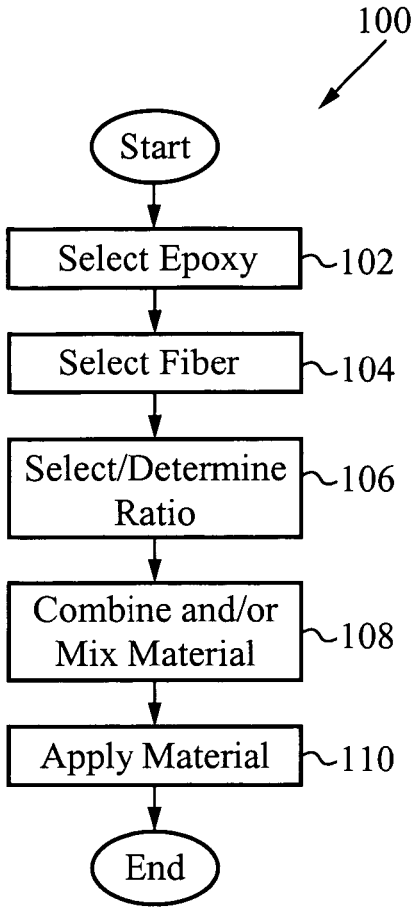
FIG. 1 illustrates process steps for a method of manufacturing and applying a projectile resistant material according to some embodiments of the invention.

FIG. 1 illustrates a method of manufacturing and applying a projectile resistant material according to some embodiments of the invention. As shown in this figure, the process 100 begins at the step 102, where an epoxy is selected.

The epoxy is typically a one, two or three part epoxy having a resin component and a hardener component. The epoxy of some embodiments is provided by Dynamis Corp. of Venice, Fla. Once an epoxy is selected at the step 102, the process 100 transitions to the step 104, where a fiber is selected. It will be apparent that the order of these selection steps can readily be reversed.

The fiber is a single type of fiber or a combination of different fibers. Typically the fibers are cut fibers having varying lengths. The fibers of some embodiments have lengths typically in the range of about 15 mm to 100 mm. These fibers include one or more of Dyneema®, Kevlar®, Spectra®, Zylon® and other similar fibers. Dyneema® is a registered trademark of Royal DSM N.V. (the Netherlands), and manufactured under agreement by Toyobo Co., LTD in Japan, and by Honeywell in the USA under the trade name Spectra®. Kevlar® is a registered trademark of DuPont. Zylon® is a registered trademark of the Toyobo Co., LTD of Japan. Currently Dyneema® and Zylon® are the strongest known fibers, at approximately 15 times the strength of steel, by weight, and up to 40% stronger than Kevlar®. It is possible that stronger fibers will be discovered in due course.

Once the fiber is selected at the step 104, the process 100 transitions to the step 106, where a ratio is selected for combining the selected epoxy and the selected fiber(s).

Preferably, the selected epoxy, fiber, fiber length, and ratio determine at least the following properties for the combined material: (1) ability to absorb energy or "hardness," (2) drying time, (3) strength, (4) viscosity, (5) ease of application, (6) adhesion strength and/or sagging, (7) weight, (8) fire resistance, (9) color and/or (10) cost. For instance, in some embodiments, the epoxy comprises about 50% to 90% of the combined material. In these embodiments, increasing the amount and/or percentage of fibers generally changes the projectile resistance of the combined material.

Additionally the ability to absorb energy and/or hardness property is related to the projectile stopping power of the material. Hardness is also related to the ability to distribute the force of projectile impact and spread the projectile over a larger surface area. The table below illustrates a relationship between the ratio of fiber to epoxy, in accordance with some embodiments. In the table below, "↑" indicates the property increases with the ratio, while "↓" indicates the property decreases with the ratio, and "na" indicates no relationship, or an unknown relationship.

| property (fiber-to-epoxy) | energy absorption "hardness" | dry time | strength | viscosity | ease of applic. | adhesion | weight | fire resist. |
|---|---|---|---|---|---|---|---|---|
| High Ratio | ↑ | na | ↑ | ↑ | ↓ | ↓ | ↓ | ↑ |
| Low Ratio | ↓ | na | ↓ | ↓ | ↑ | ↑ | ↑ | ↓ |

Once the ratio is selected at the step 106, the process 100 transitions to the step 108, where, based on the ratio, the selected epoxy and the fibers are combined and/or mixed.

Preferably, the combined material forms a projectile resistant type material. For instance, the fibers of some embodiments are mixed with the epoxy to form a random spatial arrangement. The fibers of these embodiments typically do not allow the passage of low and high velocity projectiles, such as those shot from a rifle, handgun, or that result from an explosion generated by a grenade, mine, or other destructive object or event.

After the selected epoxy and fibers are combined and mixed at the step 108, the process 100 transitions to the step 110, where the combined and/or mixed material is applied. Then, the process 100 concludes. Thereafter, the applied material dries and then cures.

Depending on the ratio and the selected epoxy and fibers, the material of some embodiments is sprayable. Hence, in these embodiments, the application of the material is by spray type means. In other embodiments, the material is more viscous and this material is instead injected, allowed to flow, and/or extruded onto a surface and/or into an opening. The method of some embodiments further comprises drilling an opening to access a recessed and/or difficult to reach area such as into a pillar of a vehicle or interior of a door panel.

Figure 2:
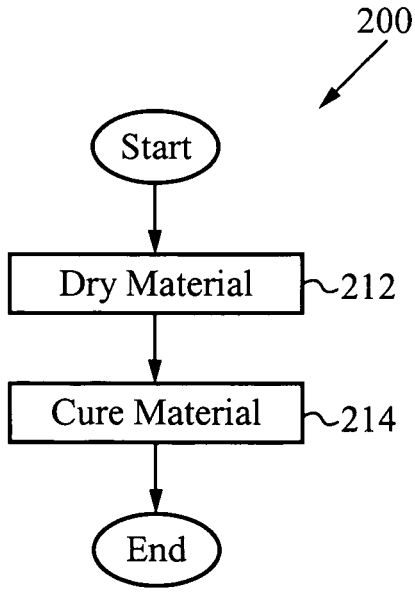
FIG. 2 illustrates additional process steps of some embodiments.

Regardless of the type of application, the material is preferably dried and cured in place. FIG. 2 illustrates the additional process steps of some embodiments for drying and/or curing the applied material. Accordingly, the process 200 begins at the step 212, where the applied material is preferably dried into place. Under normal conditions, there are no specialized drying requirements. In cold conditions, such as under 50 degrees Fahrenheit, for example, heat is preferably applied particularly during the initial catalyst reaction. Preferably, the material generally dries quickly, typically within 15 minutes to 120 minutes of application.

Once the material dries at the step 212, the process transitions to the step 214, where the material is further preferably cured. For some applications, for instance a two inch thick spray application, curing typically requires approximately 48 hours. In some instances, the material is transportable within 12 hours. The material of these embodiments generally reaches maximum projectile resistance within about 24 to 72 hours.

II. Exemplary Application System

Figure 3:
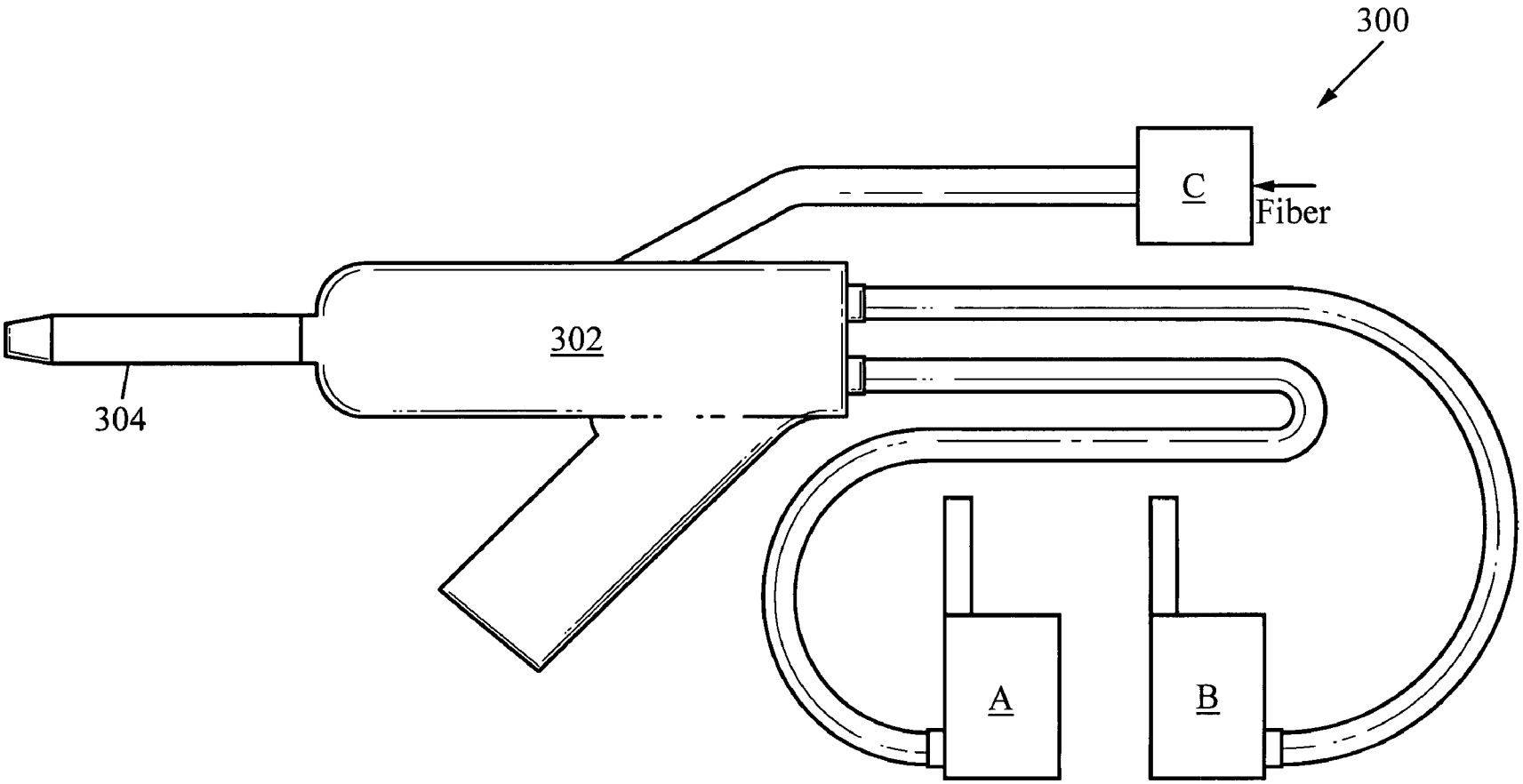
FIG. 3 illustrates a device for the application of the material of some embodiments.

In some cases, an automated mixing and dispensing machine is used to apply the material(s) for armoring and projectile resistance. Alternatively, FIG. 3 illustrates a system 300 that includes an applicator device for the application of the material of some embodiments. As shown in this figure, the system 300 includes a gun 302 that has mixing tube 304. The mixing tube 304 of some embodiments is metal and includes additional pressurizing and/or heating capabilities. The gun 302 is coupled to one or more containers such as drums A, B, and C. The gun 302 of some embodiments is used to combine and mix the fiber with an epoxy, and further, apply the combined material to a surface. As mentioned above, applying the material typically includes spraying onto a surface, injection, and/or extrusion into a cavity.

Also mentioned above, the epoxy is typically a gel type epoxy that has A and B, or additionally C, components, such as resin and hardener, for instance. Preferably, the selected epoxy does not drip or sag during application. Sag is often affected by the viscosity and other properties of the epoxy. Also, the epoxy should not dry too quickly or too slowly, and is not too soft or brittle, such that it is difficult to handle or such that it does not perform its function during operation in the field.

As shown in FIG. 3, for an A and B type epoxy, the drums A and B typically contain the resin and hardener for the epoxy, while the drum C typically includes the fiber. Hence, the gun 302 receives the resin and hardener from the drums A and B, and combines these A and B components to form the epoxy material in the mixer tube 304. Preferably, the gun 302 also receives the fiber from the drum C to mix with the epoxy in the mixer tube 304, before the combined and/or mixed material exits the mixer tube 304 and is applied to an external locus.

The pressure applied through the gun 302 and the mixer tube 304 is typically dependent on the type of application. For instance, in some spray type applications, the pressure through the gun 302 and/or the mixer tube 304 is high, such as on the order of about 2500 psi, for example. In these embodiments, the material exits the mixer tube 304 at high velocity suitable for the spray type application. In other embodiments, the pressure through the gun 302 and/or mixer tube are relatively low. These embodiments are more suitable for flow and/or extrusion type applications. Flow type application is typically used for hard to reach areas, such as recessed areas. For instance, a hole is drilled to access a hollow space. Then, the material is applied through a low pressure flow. In this manner, pillars, posts, doors, ceiling panels, floor boards, and other inaccessible hollow spaces are advantageously filled. In another instance, the material is preferably spray applied to a molded surface. After application, the surface is optionally treated in additional steps to provide evenness or texturing.

Typically, an external pressure is provided to one or more of the drums A, B, and/or C. For instance, in some embodiments an air pressure device, or a piston, or other suitable fluid driving means are coupled to the drums A and B for the pressurized delivery of the epoxy components (A and B). Additionally, the drum C includes a vacuum and/or pressure means for proper delivery of the fiber. The drum C holds a number of fibers of a single type, or a combination of types, for delivery to the gun 302. One of ordinary skill recognizes variations to the combination and/or mixing performed separately, or in conjunction with, the gun 302, in different embodiments. For instance, some embodiments will include a step that changes the combined material to have a desirable color. In another instance, the gun 302 includes heating to one, or more, of the material and its components.

In the embodiment described above, fibers are introduced to the epoxy at the end of the applicator gun 302 in the mixer tube 304. Alternatively, the fibers are combined with the epoxy at the beginning of the transfer through the hoses, instead. In still a further embodiment, the fibers are pre-mixed with one or more components of the epoxy, such as in the drum A and/or the drum B, prior to delivery to the gun 302, and prior to application from the end of the mixer tube 304. One of ordinary skill will recognize further variations for the mixing and application of the projectile resistant material. Regardless of these, some embodiments combine, mix, and/or apply the epoxy and fibers according to the factors indicated above. For instance, for greater protection from projectiles, a greater proportion of fibers are included in the ratio.

III. Projectile Resistant Material

Figure 4:
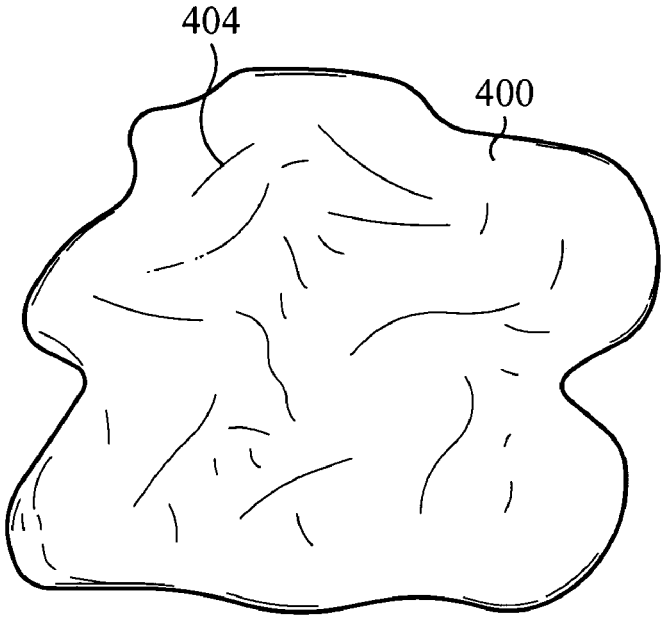
FIG. 4 illustrates a low fiber to epoxy ratio material.
Figure 5:
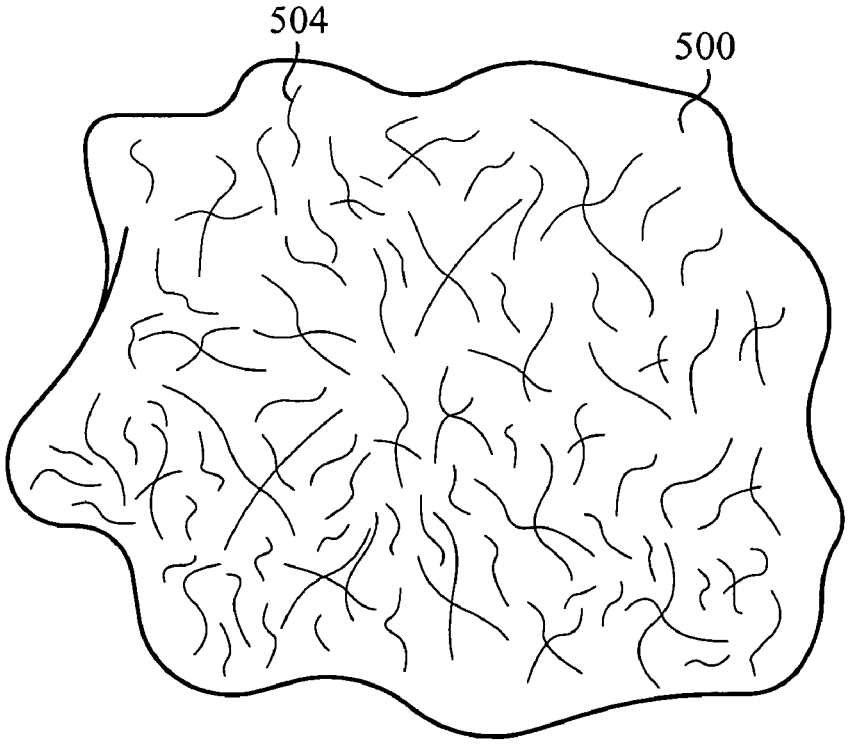
FIG. 5 illustrates a high fiber to epoxy ratio material.

The processes described above typically yield a novel projectile resistant material that is advantageously applied quickly as needed in a critical or dangerous field situation. As also discussed above, the material is sprayed on or injected into hard to reach areas that previously presented accessibility and/or protective issues. FIG. 4 illustrates the material having a low ratio of fiber 402 in relation to epoxy 400 according to some embodiments. In contrast, FIG. 5 illustrates the material having a high ratio of fiber 502 in relation to epoxy 500, according to additional embodiments.

The material of some embodiments is heat resistant to about 600 degrees Fahrenheit, and is also water and chemical resistant. These additional advantages will be further discussed below. The material also typically receives single or even multiple projectile impacts before failing. The performance of these implementations is exemplified below in relation to a set of experiments.

IV. Experiments

A. Firing Projectile into Block Experiments.

In one experiment, several blocks of material varying in composition ratios and thicknesses were formed by using the methods described above. Test projectiles were then fired into the exemplary blocks of material. The table below represents some of these experimental results, which indicate the thickness required to stop each projectile.

| | muzzle velocity (max. fps) | distance to target (max. feet) | material thickness (inches) |
|---|---|---|---|
| Projectile caliber | | | |
| .22 caliber | | 15 | 0.5 |
| .223 (Remington) | 2900-3200 | 15 | 2.0 |
| .30-06 (Springfield) or AP (armor piercing) | | 15 | 2.0 to 2.5 |
| .357 magnum | 1395 | 15 | 1.0 |
| .380 ball round (Claymore mine) | 1200 | 15 | 1.0 |
| .44 magnum | 1400 | 15 | 1.5 |
| .45 | 1400 | 15 | 1.5 |
| metric | | | |
| 5.56 × 45 mm (M-16, AR-15, NATO, same as .223 Remington) | 2900-3200 | 15 | 2.0 to 2.5 |
| 7.62 × 39 mm (AK-47) | 2330 | 15 | 2.0 to 2.5 |
| 7.62 × 63 mm (same as 30-06 Springfield) | | 15 | 2.0 to 2.5 |
| 9 mm | 1114 | 15 | 1.0 |

B. Vehicle Armoring Example.

A military HUM-V has a large amount of armorable surface area. To armor this surface area with a two inch thickness, requires an estimated 50 gallons of mixed material. Hence, a 1:1 hardener to resin mixture requires approximately 25 gallons of resin and 25 gallons of hardener. Accordingly, the total estimated cost of armoring the HUM-V in accordance with the embodiments described above has a 50% savings over conventional methods. The weight savings will vary greatly based on the Threat Level of protection and whether the comparisons are to steel panels or fiber panels.

C. Other Structure Armoring Examples.

Temporary and/or mobile building type structures also benefit from the armoring applications described above. For instance, bunker and/or tent type structures are also candidates for armoring such as by spray type applications. Further, other, more permanent structures benefit from armoring as well. For instance, some embodiments include spraying a mixture of the material to provide armoring for a surface of the wall and/or structure. Moreover, a typical wall of a building structure has hollow spaces within the framing and/or masonry. Advantageously, some applications fill the hollow spaces within the wall to provide armoring for the building structure. One of ordinary skill recognizes that application within the hollow spaces alternatively includes spraying, extrusion, and/or flow type applications.

Advantages

As described above, embodiments of the invention are useful in a variety of applications including, for example, vehicles, both land and amphibious. Additional embodiments are contemplated for other types of structures such as bunkers, buildings, coverings for weapons, fuel, supplies, and the like. These embodiments include military, police, and civilian applications. For instance, civilian applications include personal or limousine transports, as well as armored cars and trucks for the transportation of currency and other valuable items.

Weight

While providing armored protection that meets or exceeds the efficacy of conventional metal plates and/or Keviar cloth, some embodiments perform substantially the same function at a greatly reduced weight. For instance, a plate and/or box of two inch thick material in accordance with the invention typically has a stopping power as described in the table above. This plate and/or box of material typically has dimensions of 4" by 4" by 2" and weighs about two pounds. For Threat Level III protection, the thickness requirement is typically reduced to about 1.0" and 50% of the weight, or about 1.0 pound, in this example.

Cost

As mentioned above, the conventional methods of armoring have high material costs, which do not include the additional cost of extensive modification to the armored equipment, vehicle, and/or structure. In contrast, typical costs of the mixed material of some embodiments represents greatly reduced costs in both material and labor over the conventional armor. Hence, as illustrated in the example above, embodiments of the invention may have a cost and/or weight savings of approximately 50%, or more, over conventional methods.

Speed

As described above, various embodiments of the invention are sprayed, flowed, and/or extruded in a myriad of applications. The ease of application and portability of the materials allow the armoring process to be performed quickly, in a manner which is unknown to the art. Moreover, the novel methods and speed of application further allows for the simplified conversion of existing vehicles and/or structures to include armored protection, without the need for extensive and time consuming disassembly and modification.

Others

Other features and advantages of the invention are understood by one of ordinary skill. For instance, often in times of exigency, there is a need for a quickly defensible structure such as a bunker or a guard post. Then, as quickly as the defensive position is needed, it may need to be abandoned and left without regard to its cost and time to erect. Some embodiments provide for a method and means for generating a defensible position having a selectively variable amount of protection, as needed, without the concerns of time and costs at deployment or abandonment.

Moreover, the epoxy and/or resulting projectile resistant material also functions as an adhesive, in some embodiments. The material of the embodiments further add bonding and structural integrity to the armored underlying and/or overlying structure. Preferably, in these embodiments, the epoxy bonds to polyethylene, such as polyethylene fibers, for greater performance of the projectile resistant material.

While the invention has been described with reference to numerous specific details, one of ordinary skill in the art will recognize that the invention can be embodied in other specific forms without departing from the spirit of the invention. Thus, one of ordinary skill in the art will understand that the invention is not to be limited by the foregoing illustrative details, but rather is to be defined by the appended claims.

The invention claimed is:

1. A projectile resistant material comprising:

a non-foam gel epoxy; and a plurality of fibers, the fibers mixed within the epoxy based on a predetermined ratio, the predetermined ratio for determining a projectile resistance of the material, wherein the fibers are mixed with the epoxy to form a random spatial arrangement of fibers within the epoxy.

2. The material of claim 1, wherein the material is sprayable.

3. The material of claim 1, wherein the material is extruded.

4. The material of claim 1, wherein the material is configured to be formed and used on-site in a field situation.

5. The material of claim 1, wherein the material comprises fibers having approximately 15 times the strength of steel by weight.

6. The material of claim 1, wherein the material is configured for injection into a hard to reach area.

7. The material of claim 6, wherein the hard to reach area is in the set comprising a pillar, a roof, a frame rail, a body panel, and a floor board.

8. The material of claim 6, wherein the hard to reach area is located on a vehicle.

9. The material of claim 1, wherein the epoxy comprises a two stage epoxy having the trade name Epogel.

10. The material of claim 1, wherein the fibers comprise fibers having varying lengths.

11. The material of claim 1, wherein the fibers have variable lengths in the range of about 15 millimeters to 100 millimeters.

12. The material of claim 1, wherein the fiber comprises a combination of fiber materials.

13. The material of claim 1, wherein the epoxy comprises about 50% to 90% of the mixed material.

14. The material of claim 1, wherein increasing the amount of fibers, increases the ballistic resistance of the combined material.

15. The material of claim 1, wherein the ratio is determined based on a set of desired properties for the combined material, the set comprising:

hardness, drying time, strength, viscosity, ease of application, adhesion strength, sagging, weight, fire resistance, and color.

16. The material of claim 1, wherein a property of hardness is related to a projectile stopping power.

17. The material of claim 1, wherein the property of hardness is related to an ability to distribute a force of a projectile impact, wherein distributing the force of the projectile impact spreads a projectile over a larger surface area.

18. A method of applying a projectile resistant material, the method comprising:

selecting a non-foam gel epoxy;

selecting a fiber;

selecting a ratio for combining the epoxy and the fiber; and based on the ratio, combining the epoxy and the fiber to form a malleable projectile resistant material, wherein the fibers are mixed with the epoxy to form a random spatial arrangement of fibers within the epoxy.

19. The method of claim 18, wherein applying the material comprises spraying.

20. The method of claim 18, wherein applying the material comprises extruding.

21. The method of claim 18, wherein applying the material comprises an automated mixing and dispensing machine.

22. The method of claim 18, wherein the epoxy comprises a two stage epoxy having the trade name Epogel.

23. The method of claim 18, wherein the fibers are cut fibers having varying lengths.

24. The method of claim 18, wherein the fibers have variable lengths in the range of about 15 mm to 100 mm.

25. The method of claim 18, wherein the fibers are selected from the set comprising Dyneema, Kevlar, Spectra, and Zylon.

26. The method of claim 18, wherein the selected fiber comprises approximately 15 times the strength of steel by weight.

27. The method of claim 18, wherein the selected fiber comprises a combination of fibers.

28. The method of claim 18, wherein the epoxy comprises about 50% to 90% of the mixed material.

29. The method of claim 18, wherein increasing the amount of fibers, increases the ballistic resistance of the combined material.

30. The method of claim 18, wherein the ratio is selected based on a set of desired properties for the combined material, the set comprising:

hardness, drying time, strength, viscosity, ease of application, adhesion strength, sagging.

31. The method of claim 18, wherein the property of hardness is related to a projectile stopping power.

32. The method of claim 18, wherein the property of hardness is related to the ability to distribute the force of a projectile impact, wherein distributing the force of the projectile impact spreads the projectile over a larger surface area.

33. The method of claim 18, further comprising:

drying the applied material; and curing the applied material.

34. The method of claim 33, wherein the material generally dries quickly, within about one hour.

35. The method of claim 33, wherein curing typically requires approximately 48 hours.

36. The method of claim 33, wherein the material is useable within 24 hours.

37. The method of claim 33, wherein the material achieves maximum projectile resistance in about 72 hours.

38. A projectile resistant material comprising:

a non-foaming gel epoxy; and a plurality of fibers, the fibers mixed within the epoxy based on a predetermined ratio, the predetermined ratio for determining a projectile resistance of the material, wherein the fibers are mixed with the epoxy to form a substantially random X-Y-Z spatial arrangement of fibers within the epoxy.

39. A method of forming a projectile resistant material, the method comprising:

selecting a non-foam gel epoxy;

selecting a fiber;

selecting a ratio for combining the epoxy and the fiber; and based on the ratio, combining the epoxy and the fiber to form a malleable projectile resistant material, wherein the fibers are mixed with the epoxy to form a substantially random X-Y-Z spatial arrangement of fibers within the epoxy.

* * * * *